US005192637A

United States Patent [19]

Saito et al.

[11] Patent Number: 5,192,637

[45] Date of Patent: Mar. 9, 1993

[54] ELECTROPHOTOGRAPHIC TONER COMPOSITION

[75] Inventors: Susumu Saito; Takashi Imai; Satoshi Inoue; Yutaka Sugizaki, all of Kanagawa, Japan

[73] Assignee: Fuji Xerox Co., Ltd., Tokyo, Japan

[21] Appl. No.: 710,617

[22] Filed: Jun. 5, 1991

[30] Foreign Application Priority Data

Jun. 6, 1990 [JP] Japan ..... 2-146254

[51] Int. Cl.[5] ..... G03G 9/087

[52] U.S. Cl. ..... 430/109; 430/110

[58] Field of Search ..... 430/110, 106.6, 903, 430/109

[56] References Cited

U.S. PATENT DOCUMENTS 4,985,328 1/1991 Kumagai et al. ..... 430/110

5,032,484 7/1991 De Mejo et al. ..... 430/110

OTHER PUBLICATIONS

Hawley's Condensed Chemical Dictionary, 11th ed., 1987, pp. 1037, 1038, 1041, 1130, 1158, and 1159.

*Primary Examiner*—John Goodrow

*Attorney, Agent, or Firm*—Finnegan, Henderson, Farabow, Garrett and Dunner

[57] ABSTRACT

An electrophotographic toner composition comprising a toner particle and an additive is disclosed, the toner particle comprising at least a binder resin and a colorant, and the additive being an amorphous titania fine particle subjected to a surface treatment using a coupling agent.

15 Claims, No Drawings

ELECTROPHOTOGRAPHIC TONER COMPOSITION

FIELD OF THE INVENTION

The present invention relates to an electrophotographic toner composition for use in development of electrostatic latent images according to electrophotographic or electrostatic recording processes.

BACKGROUND OF THE INVENTION

Heretofore, as an electrophotographic developer used to make an electrostatic latent image formed on an electrophotographic light-sensitive layer visible, a one-component developer or a two-component developer has been used. The one-component developer is prepared by melt kneading a mixture of a resin (e.g, polystyrene, a styrene-butadiene copolymer and a polyester) and a pigment or dye (e.g, carbon black and Phthalocyanine Blue) as a colorant, and then grinding it. The two-component developer comprises a toner and a carrier having, for example, an average particle diameter nearly equal to that of the toner or up to 500 μm, and the carrier is a glass bead, a particle of iron, nickel or ferrite, or those covered with a resin.

These developers, when used without other additives, are not satisfactory in storage stability (antiblocking), conveying properties, developability, transferability, charging properties, and so forth. Thus, in order to improve these properties, additives are often added. Hydrophobic fine powders are used as an additive, such as hydrophobic silica, a mixture of silica fine particles and alumina or titania fine particles, alumina-covered titania fine particles, and so forth. As the titania, titania having a rutile or anatase crystal structure is used.

By using hydrophobic fine powders such as silica fine particles now often used, the properties of the developers are considerably improved with respect to storage stability, conveying properties, developability and transferability. However, if they are used in such an amount that the above properties are sufficiently improved, a problem arises in that chargeability is adversely influenced. Concerning chargeability, the developers are required to exhibit satisfactory efficiency with respect to charged amount, rapid charging ability, distribution of charged amount, admixing properties, charging stability under various atmosphere, and so forth When silica fine particles are used for example, they exert adverse influences on the rapid charging ability, the distribution of charged amount, the admixing properties, and the charging stability.

Addition of alumina or titania fine particles together with silica fine particles as admixture improves the rapid charging ability, the distribution of charged amount, the admixing properties and the charging stability, but it results in marked decrease in the charged amount. All the above-mentioned requirements for chargeability are met using the admixture only under specific conditions, and the improving effects are not satisfactory, particularly in the charging stability under various atmosphere.

Rutile-type or anatase-type titania fine particles to be used as an additive are necessarily subjected to treatments, such as a treatment for making the particles hydrophobic by using various coupling agents and a treatment for coating the particles with alumina. Otherwise, the untreated titania particles are hardly charged. Titania fine particles subjected to the hydrophobic treatment using a coupling agent are effective for improving the chargeability to some extents but the effect is still insufficient. In particular, satisfactory charging stability cannot be attained when used with toners comprising a polyester as a binder resin. On the other hand, the alumina treatment does not effectively prevent aggregation of the titania particles and the titania particles exhibit poor dispersibility.

SUMMARY OF THE INVENTION

An object of the present invention is to provide a toner composition having an improved chargeability, particularly in the charged amount, the charging stability under various atmosphere and the admixing properties.

As a results of intensive study to overcome the above prior art problems, it has been found that the object is attained by using, as an additive, an amorphous titania fine particle subjected to a surface treatment using a coupling agent.

The present invention relates to an electrophotographic toner composition comprising (i) a toner particle comprising at least a binder resin and a colorant, and (ii) an amorphous titania fine particle subjected to a surface treatment using a coupling agent as an additive.

DETAILED DESCRIPTION OF THE INVENTION

Amorphous titania differs from crystalline titania such as those Rutile-type (tetragonal), anatase-type (tetragonal) or lutile-anatase mixed type, in that the former does not exhibit distinct peaks in an X-ray diffraction pattern. Other differences between the former and the latter are shown in Table 1 below.

TABLE 1

| | Amorphous-Type | Rutile-Type | Anatase Type |
|---|---|---|---|
| Shape | spherical | rice-like | rice-like |
| Particle size | about 100 to 300 angstroms | about 150 to several thousands angstroms | about 150 to several thousands angstroms |
| Specific surface area | 100 × 160 $m^2/g$ | less than 100 $m^2/g$ | less than 100 $m^2/g$ |
| Water content | 6 to 10 wt % | none (only physically adsorbed water) | none (only physically adsorbed water) |
| True density | 3.50 $g/m^2$ or less | 3.9 $g/cm^2$ | 4.2 $g/cm^2$ |
| Number of hydroxy group on surface per g | $2 \times 10^{20}$ or more | $1.4 \times 10^{20}$ | $1.4 \times 10^{20}$ |

Since amorphous titania has more hydroxy groups on the surface than crystalline titania as described above, the former has higher reactivity with a coupling agent, so that that it can provide a higher charged amount onto the toner.

The particle diameter (primary particle diameter) of the titania particles is generally not more than 1.0 μm and preferably not more than 0.3 μm.

The amorphous titania particles to be used as the additive in the present invention need be subjected to a surface treatment using a coupling agent. When the particles are not subjected to the surface treatment, they exhibit almost the same chargeability as that of Rutile- or anatase-type titania, particles, and the charged amount of the amorphous titania particles is small. Once the surface treatment using a coupling agent is applied, the resulting amorphous titania particles have a markedly increased charged amount as compared with that of the Rutile- or anatase-type titania particles. The reason for this is considered that many hydroxyl groups exist on the surface of the amorphous titania particle, and they bond with the coupling agent to thereby increase the charged amount.

As the coupling agent to be used in the present invention, those capable of reacting with a hydroxyl group are used, such as silane coupling agents, titanate coupling agents, aluminium-based coupling agents and zirconium-based coupling agents. Preferred silane coupling agents are represented by formulae (I), (II) and (III) shown below:

$$R_{4-x}Si(NCO)_x \quad (I)$$

$$R_{4-x}Si(OR')_x \quad (II)$$

$$R_{4-x}SiCl_x \quad (III)$$

wherein x is an integer of 1 to 3, R is an alkyl group or perfluoroalkyl group generally having up to 50 carbon atoms and preferably having 1 to 10 carbon atoms, and R' is an alkoxy group such methoxy or ethoxy.

Specific examples are $(CH_3)_2Si(NCO)_2$, $CH_3Si(NCO)_3$, $C_{10}H_{21}Si(OCH_3)_3$, and $CF_3Si(OCH_3)_3$. Those in which x is 3 are preferred in that the charged amount is increased to a large extent.

The treatment of the amorphous titania particles is classified into two types, i.e., a dry method and a wet method. In the dry method, the amorphous titania particles are dispersed in an alcohol or another organic solvent, to which a coupling agent is added in the forming an aqueous solution for example, and then the water, alcohol, organic solvents used are removed from the mixture to dry, and optionally followed by heating and grinding the dried product. In the wet method, a coupling agent is dissolved in water, an alcohol on another organic solvent and the solution was poured over the amorphous titania particle while uniformly stirring using a blender such as a Henschel mixer, a super mixer and the like.

The coupling agent is generally used in an amount of 0.1 to 30% by weight, preferably 3 to 20% by weight, based on the weight of the amount of titania particles.

In the toner composition of the present invention, the thus-treated amorphous titania particles are added in an amount of 0.5 to 3% by weight, preferably 0.5 to 2% by weight based on the weight of the toner particles.

The toner particles which are the other component of the toner composition of the present invention are not particularly limited, and conventional toner particles comprising at least a colorant and a binder resin are used.

Examples of the binder resin are homopolymers or copolymers of the following monomer(s): styrenes such as styrene and chlorostyrene; monoolefins such as ethylene, propylene, butylene and isoprene; vinyl esters such as vinyl acetate, vinyl propionate, vinyl benzoate, and vinyl acetate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers such as vinyl methyl ether, vinyl ethyl ether, and vinyl butyl ether; and vinyl ketones such as vinyl methyl ketone, vinyl hexyl ketone, and vinyl isopropenyl ketone. Particularly preferred are polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene, polypropylene. In addition, polyester, polyurethane, an epoxy resin, a silicone resin, polyamide, modified rosin, paraffin, and waxes can be used.

Polyester is particularly effectively used as the binder resin in the present invention. As an alcohol component constituting the polyester, bisphenol A and bisphenol derivatives represented by formula (IV) are used:

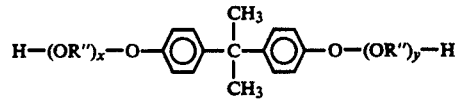

(IV)

wherein R'' is an ethylene group or a propylene group, and x and y each represents an integer of 1 or more, provided that the total of x and y is within the range of 2 to 6. Other alcohol components may also be used with bisphenol A or the above bisphenol derivatives, such as ethylene glycol, propylene glycol, 1,3-butanediol, 1,4-butanediol, 2,3-butanediol, diethylene glycol, 1,5-pentanediol, 1,6-hexanediol, neopentyl glycol, hydrogenated bisphenol A and cyclohexanediol. Examples of an acid component constituting the polyester include dicarboxylic acids such as terephthalic acid, isophthalic acid, fumaric acid, succinic, acid, adipic acid, and sebacic acid; tricarboxylic acids such as trimellitic acid and pyromellitic acid; and acid anhydrides thereof. For example, a linear polyester resin obtained by poly-condensation of bisphenol A and a polybasic aromatic carboxylic acid as main monomer components is preferably used. More specifically, a linear polyester formed from terephthalic acid/bisphenol A-ethylene oxide adduct-/cyclohexanediol, and having a softening point of 100° to 125° C., a glass transition point of 55 to 68° C., a number average molecular weight (Mn) of $(3.3\pm0.3)\times10^3$, a weight average molecular weight (Mw) of $9.5\pm0.5\times10^3$, an acid value of 6 to 12, and a hydroxyl group value of 25 to 40 is particularly preferred.

When polyester is used as a binder resin for toner particles, the resulting toner particles can be negatively charged with a small amount of a charge controlling agent to be added thereto or even without the charge controlling agent in some cases, because the polyester itself has negative chargeability. However, the use of polyester has a drawback that the charging property of the toner particles varies to a large extent depending on the atmosphere, in other words, difference between a charged amount under high temperature and high humidity conditions and a charged amount under low temperature and low humidity conditions is large. The difference is particularly remarkable when a pigment other than carbon black is used as a colorant for toner particles. The above drawback can be eliminated by the use of the additive of the present invention. Although the detailed mechanism is not clear, it is considered that the negative chargeability of polyester is due to a carboxyl group which is a polar group of the polyester, or an ester bond therein, and that the chargeability of the polar group is easily influenced by changes in temperature and humidity, so that the charging property of the toner particles is influenced by changes in temperature and humidity. Influence of the changes in temperature and humidity cannot considerably be reduced even when a charge controlling agent is added to the polyester resin. It is surprising that the addition of amorphous titania fine particles which are subjected to a surface treatment using a coupling agent makes it possible, even under high temperature and high humidity condition, to improve uniformity of charge on the toner particle surface, to accelerate charge exchange properties of toner particles achieving rapid charging, and to narrow the distribution of charge, yet retaining the charged amount high enough for development. Thus, the dependency of charged amount on the surrounding conditions can be greatly improved according to the present invention.

Typical examples of a colorant for toner particles include carbon black, Nigrosine, Aniline Blue, Chalcoyl Blue, Chrome Yellow, Ultramarine Blue, Dupont Oil Red, Quinoline Yellow, Methylene Blue Chloride, Phthalocyanine Blue, Malachite Green Oxalate, Lamp Black, Rose Bengal, C.I. Pigment Red 48:1, C.I. Pigment Red 122, C.I. Pigment Red 57:1, C.I. Pigment Yellow 97, C.I. Pigment Yellow 12, C.I. Pigment Blue 15:1, and C.I. Pigment Blue 15:3.

In these toner particles, known additives such as an antistatic agent and a fixing aid may be incorporated.

The toner particles of the present invention generally have an average particle diameter of less than about 30 μm and preferably from 5 to 20 μm.

The electrophotographic toner composition of the present invention may be either a one-component developer not containing a carrier or a two-component developer containing a carrier. Preferably it is used in the form of two-component developer.

The carrier to be used in the two-component developer is not limited, and any known carriers can be used, such as an iron powder-based carrier, a ferrite-based carrier, a surface-coated type ferrite-based carrier, and a magnetic powder-dispersed type carrier.

In preparation of the electrophotographic toner composition, the amorphous titania particles of the present invention can be attached onto the toner particle surface by known techniques, for example, by means of a high speed mixer such as a Henschel mixer, a V-shaped blender, and the like.

The toner composition of the present invention exhibits improved chargeability of toner particles, particularly charging stability under various atmosphere (from high temperature and high humidity to low temperature and low humidity), and has a narrow charge distribution under various atmosphere, and even when used for a long period of time, it maintains a high charge amount with little generation of opposite polarity and can stabily provide copied images having good quality without fog.

The present invention is described in greater detail with reference to the following Examples, but the present invention should not be construed as being limited thereto. In the following Examples and Comparative Example, all parts are by weight unless otherwise indicated.

EXAMPLE 1

Preparation of Additive Additive a.

0.6 g of $CH_3Si(NCO)_3$ was dissolved in dehydrated ethyl acetate, and then 3 g of amorphous titania fine particles having a particle diameter of 15 nm (trade name: UFP, produced by IDEMITSU KOSAN CO., LTD.) were added. The resulting mixture was subjected to supersonic dispersion to treat the surface of amorphous titania particles, thereby forming a methyl group on the surface. The mixture was filtered, washed, dried, and then ground in a mortar to obtain Additive a. It is assumed that a hydroxy group on the amorphous titania particle surface underwent a chemical reaction with $CH_3Si(NCO)_3$, and a decomposed product resulting from the reaction was dissipated, leading to formation of a silicon oxide film having a methyl group on the surface thereof.

Additive b:

2.0 g of $C_{10}H_{21}Si(OCH_3)_3$ was dissolved in a mixed solvent of 95 parts of methanol and 5 parts of water, and then 10 g of amorphous titania particles having an average particle diameter of 15 nm (Amorphous Titania, produced by IDEMITSU KOSAN CO., LTD.) were added. The resulting mixture was subject to supersonic dispersion to attach $C_{10}H_{21}Si(OCH_3)_3$ to the surface of amorphous titania particles. The mixture was filtered, dried at 110° C., and then ground in a mortar to obtain Additive b.

Preparation of Toner Particles

Toner A:

| | |
|---|---|
| Styrene-n-Butyl Methacrylate Copolymer (Tg = 65° C., Mn = 15,000, Mw = 35,000) | 100 parts |
| Magenta Pigment (C.I. Pigment Red 57) | 3 parts |
| Potassium Tetraphenylborate | 1 part |

The above mixture was kneaded by the use of an extruder, pulverized by the use of a jet mill, and then dispersed by means of an air classifier to obtain magenta toner particles having $d_{50}=12$ μm.

The term "$d_{50}$" means a particle size of the particles at which the weight of the particles is accumulated from small ones to large ones and reaches to 50% of the total weight of the particles.

| | |
|---|---|
| Linear Polyester Resin (Linear polyester of terephthalic acid/ bisphenol A ethylene oxide adduct/ cyclohexanedimethanol; Tg = 62° C., Mn = 4,000, Mw = 10,000, acid value = 12, hydroxy value = 25) | 100 parts |
| Magenta Pigment (C.I. Pigment Red 57) | 3 parts |

The above mixture was kneaded with an extruder, pulverized with a jet mill, and then dispersed by means of an air classifier to obtain a magenta toner particle having $d_{50}=12$ μm.

Preparation of Toner Composition

Toner Compositions 1 and 2:

To 100 parts of Toner A was added 1.0 part of Additive a or Additive b, and they were then mixed by means of a high speed mixer to obtain Toner Compositions 1 and 2, respectively.

Toner Compositions 3 and 4:

To 100 parts of Toner B was added 1.0 part of Additive a or Additive b, and they were then mixed by means of a high speed mixer to obtain Toner Compositions 3 and 4, respectively.

Toner Composition 5:

To 100 parts of Toner B were added 0.8 part of Additive a and 0.4 part of silica fine powder (R972, produced by Nippon Aerogil Co., Ltd.), and they were by means of a high speed mixer to obtain Toner Composition 5.

Preparation of Developer

To 100 parts of a carrier composed of ferrite particle covered with a methyl methacrylate-styrene copolymer and having a particle diameter of about 50 μm was added 5 parts of each of Toner Compositions 1 to 5, and they were then mixed by means of a tumbler shaker mixer to prepare a developer for evaluation.

Using the above developers, a copy test was conducted on an electrophotographic coping machine (FX-790 modified machine, produced by Fuji Xerox Co., Ltd.); the developers were measured for a charged amount, a charge distribution, and an amount of toners having the opposite polarity under the conditions of high temperature and high humidity (30° C., 85% RH) and low temperature and low humidity (10° C., 15% RH).

In addition, 100 parts of the carrier and 1.7 parts of each of Toner Compositions 1 to 5 were mixed and, after 5 seconds, they were measured for the above items to evaluate admixing properties.

The charge amount was determined by spectrographic analysis by CSC (charge spectrograph method). The charge distribution was defined by the following equation:

$$\text{charged distribution} = (Q(80) - Q(20))/Q(50)$$

wherein

Q(20) indicates the charged amount of toner particles integrated in the range of 0 to 20% in the charge spectrograph, Q(80) indicates the charged amount of toner particles integrated in the range of 0 to 80% in the charge spectrograph, and Q(50) indicates the charged amount of toner particles integrated in the range of 0 to 50% in the charge spectrograph.

The results are shown in Table 1.

COMPARATIVE EXAMPLE

Preparation of Additive Additive c and Additive d:

Crystalline titania particles (P-25, produced by Nippon Aerogil Co., Ltd.) and crystalline titania particles (MT-150A, produced by Teika Co., Ltd.) were treated under the same conditions as in preparation of the additives in Example 1 to obtain Additive c and Additive d, respectively.

Preparation of Toner Composition

Toner Composition 6 and Toner Composition 7:

To 100 parts of each of Toner A and Toner B of Example 1 was added 1.0 part of Additive c, and they were mixed at a high speed to obtain Toner Composition 6 and Toner Composition 7, respectively.

Toner Composition 8 and Toner Composition 9:

To 100 parts of each of Toner A and Toner B of Example 1 was added 1.0 part of Additive d, and they were mixed at a high speed to obtain Toner Composition 8 and Toner Composition 9, respectively.

Toner Composition 10:

To 100 parts of Toner B of Example 1 was added 1.0 part of hydrophobic silica fine powder (R972, produced by Nippon Aerogil Co., Ltd.), and they were mixed at a high speed to obtain Toner Composition 10.

Toner Composition 11:

To 100 parts of Toner B of Example 1 was added 1.0 part of amorphous titania not subjected to a surface treatment, and they were mixed at a high speed to obtain Toner Composition 11.

These toner compositions were evaluated using the same carrier as used in Example 1 and in the same manner as in Example 1. The results are shown in Table 1.

TABLE 1

| | One Minute after mixing | | | | | |
|---|---|---|---|---|---|---|
| | High Temperature, High Humidity | | | Low Temperature, Low Humidity | | |
| Toner Composition No. | Charged Amount (μC/g) | Charge Distribution | Amount of Toner with Opposite Polarity (wt %) | Charged Amount (μC/g) | Charge Distribution | Amount of Toner with Opposite Polarity (wt %) |
| 1 | −13.3 | 0.5 | 0 | −16.3 | 0.6 | 0 |
| 2 | −15.2 | 0.6 | 0 | −18.5 | 0.6 | 0 |
| 3 | −10.5 | 0.6 | 0 | −13.9 | 0.6 | 0 |
| 4 | −12.0 | 0.5 | 0 | −10.0 | 0.6 | 0 |
| 5 | −13.0 | 0.7 | 0 | −17.2 | 0.7 | 0 |
| 6 | −5.0 | 0.5 | 0 | −7.0 | 0.5 | 0 |
| 7 | −6.1 | 0.5 | 0 | −7.5 | 0.5 | 0 |
| 8 | −4.0 | 0.5 | 0 | −5.5 | 0.5 | 0 |
| 9 | −5.1 | 0.5 | 0 | −6.5 | 0.5 | 0 |
| 10 | −8.0 | 0.9 | 5 | −25.0 | 1.0 | 3 |
| 11 | −1.2 | 0.7 | 35 | −2.0 | 0.9 | 41 |

| | 5 Seconds after mixing | | | | | |
|---|---|---|---|---|---|---|
| | High Temperature, High Humidity | | | Low Temperature, Low Humidity | | |
| Toner Composition No. | Charged Amount (μC/g) | Charge Distribution | Amount of Toner with Opposite Polarity (wt %) | Charged Amount (μC/g) | Charge Distribution | Amount of Toner with Opposite Polarity (wt %) |
| 1 | −10.5 | 0.6 | 0 | −13.3 | 0.6 | 0 |
| 2 | −12.0 | 0.6 | 0 | −15.5 | 0.6 | 0 |
| 3 | −8.2 | 0.6 | 0 | −11.1 | 0.6 | 0 |
| 4 | −11.0 | 0.6 | 0 | −9.5 | 0.6 | 0 |
| 5 | −12.0 | 0.7 | 0 | −16.1 | 0.7 | 0 |
| 6 | −4.2 | 0.5 | 0 | −6.0 | 0.5 | 0 |
| 7 | −4.8 | 0.5 | 0 | −6.8 | 0.5 | 0 |
| 8 | −3.8 | 0.5 | 0 | −4.2 | 0.5 | 0 |
| 9 | −4.0 | 0.5 | 0 | −4.0 | 0.5 | 0 |

TABLE 1-continued

| | | | | | | |
|---|---|---|---|---|---|---|
| 10 | −6.5 | 0.9 | 7 | −20.0 | 1.0 | 10 |
| 11 | −0.3 | 0.8 | 43 | −0.9 | 0.9 | 49 |

It is seen from the results that the toner compositions of the present invention (Toner Compositions 1-5) exhibit almost no change in the charged amount under both the low temperature and low humidity condition, and the high temperature and high humidity condition, and show very sharp distribution with respect to the charged amount.

Even after 10,000 sheets were copied using these toner compositions, no change in image density due to change in the atmosphere was observed, and images having good quality without fog (background contamination) were obtained stably.

When the hydrophobic silica was added as an additive (Toner Composition 10), on the other hand, the charged amount was changed to a large extent due to change in the atmosphere. Further, the charged amount distribution was broad, and the rapid charging ability was insufficient. The copied images had varied image densities due to change in the atomsphere, and fog was observed.

When the crystalline titania was added (Toner Compositions 6-9), the charge amount was small, and from the beginning of copying, fog was observed in the copied images.

When the amorphous titania not subjected to the surface treatment was added (Toner Composition 11), the charged amount was extremely low, and the amount of toners having the opposite polarity was large. Thus, the toner composition was not practical.

EXAMPLE 2

| | |
|---|---|
| Styrene-n-Butyl Methacrylate (70/30 by weight) Copolymer (Mn = about 7,000, Mw = about 40,000) | 97 parts |
| Cyan Pigment (β-type Phthalone Cyanine:C.I. Pigment Blue 15:3) | 3 parts |

The above components were melt kneaded, finely divided, and classified to obtain cyan toner particles having $d_{50}=12$ μm.

To 100 parts of the cyan toner particles was added 0.7 part of Additive a used in Example 1, and they were mixed by the use of a high speed mixer to obtain a cyan toner composition. The cyan toner composition exhibited good fluidity.

100 parts of a carrier comprising ferrite having a particle diameter of about 50 μm and covered with a methyl methacrylate-styrene copolymer, and 6 parts of the above cyan toner composition were mixed to obtain a developer.

This developer was subjected to a copy test on copying machine (FX4700, produced by Fuji Xerox Co., Ltd.). Under the conditions from high temperature and high humidity (30° C., 85% RH) to low temperature and low humidity (10° C., 15% RH), no contamination of the background was observed, and from the beginning of copying, images having high density and high image quality were obtained. Even after continuous copying of 10,000 sheets, the image qualities of the copied images were substantially the same from the beginning.

EXAMPLES 3 AND 4

Magenta toner particles and yellow toner particles each having an average particle diameter of 12 μm were obtained in the same manner as in Example 2 except that 3 parts of the cyan pigment was replaced by 3 parts of a magenta pigment (Brilliant Carmine 6BC: C.I. Pigment Red 57) and a yellow pigment (Disazo Yellow: C.I. Pigment Red 12), respectively.

To 100 parts of each of the magenta toner particles and the yellow toner particles was added 1.0 part of Additive a used in Example 1, and they were mixed by the use of a high speed mixer to obtain a magenta toner composition and a yellow toner composition, respectively. These toner compositions exhibited good fluidity.

In the same manner as in Example 2, developers were prepared, and were subjected to a copy test. Under the conditions from high temperature and high humidity to low temperature and low humidity, no contamination of the background was observed, and copied images having high density and high image quality were obtained. Even after continuous copying of 10,000 sheets, the image qualities of the copied images were substantially the same from the beginning.

While the invention has been described in detail and with reference to specific embodiments thereof, it will be apparent to one skilled in the art that various changes and modifications can be made therein without departing from the spirit and scope thereof.

What is claimed is:

1. An electrophotographic toner composition comprises a toner particle and an additive, wherein said toner particle comprises at least a binder resin and a colorant, and said additive is an amorphous titania particle subjected to a surface treatment using a coupling agent.

2. The composition as in claim 1, wherein the binder resin is a polyester resin.

3. The composition as in claim 1, wherein said coupling agent is a silane coupling agent represented by formula (I), (II) or (III)

$$R_{4-x}\,Si(NCO)_x \quad (I)$$

$$R_{4-x}\,Si(OR')_x \quad (II)$$

$$R_{4-x}\,SiCl_x \quad (III)$$

wherein R represents an alkyl group or a perfluoroalkyl group, R' represents an alkoxyl group, and x is an integer of 1 to 3.

4. The composition as in claim 3, wherein said silane coupling agent is selected from the group consisting of $(CH_3)_2Si(NCO)_2$, $CH_3Si(NCO)_3$, $C_{10}H_{21}Si\text{-}(OCH_3)_3$, and $CF_3Si(OCH_3)_3$.

5. The composition as in claim 1, wherein said coupling agent is adhered on the amorphous titania particle in an amount of 0.1 to 30% by weight based on the weight of the amorphous titania particle.

6. The composition as in claim 5, wherein said coupling agent is adhered on the amorphous titania particle in an amount of 3 to 20% by weight based on the weight of the amorphous titania particle.

7. The composition as in claim 1, wherein said amorphous titania particle is contained in an amount of 0.5 to 3% by weight based on the weight of the toner particle.

8. The composition as in claim 7, wherein said amorphous titania particle is contained in an amount o f 0.5 to 2% by weight based on the weight of the toner particle.

9. The composition as in claim 1, wherein said amorphous titania particle has a primary particle size of not more than 1.0 μm.

10. The composition as in claim 9, wherein said amorphous titania particle has a primary particle size of not more than 0.3 μm.

11. The composition as in claim 2, wherein said polyester resin is a linear polyester resin obtained by polycondensation of bisphenol A and a polybasic aromatic carboxylic acid as main monomer components.

12. An electrophotographic toner composition comprising:

a toner particle comprising at least a binder resin and a colorant;

a first additive comprising an amorphous titania particle and a coupling agent adhered to a surface of the amorphous titania particle; and a second additive comprising a hydrophobic silica particle.

13. The composition as in claim 12, wherein the toner particle has an average particle diameter of from 5 to 20 μm.

14. The composition as in claim 12, wherein the binder resin is a polyester resin.

15. The composition as in claim 14, wherein the polyester resin is a linear polyester resin obtained by polycondensation of bisphenol A and a polybasic aromatic carboxylic acid as main components.

* * * * *